US008499929B2

(12) United States Patent
Chatelain

(10) Patent No.: US 8,499,929 B2
(45) Date of Patent: Aug. 6, 2013

(54) SLIDE AND SHELL CONTAINER

(75) Inventor: Lucas Chatelain, Savigny (CH)

(73) Assignee: Philip Morris USA Inc., Richmond, VA (US)

( * ) Notice: Subject to any disclaimer, the term of this patent is extended or adjusted under 35 U.S.C. 154(b) by 280 days.

(21) Appl. No.: 12/975,943

(22) Filed: Dec. 22, 2010

(65) Prior Publication Data

US 2011/0147243 A1 Jun. 23, 2011

(30) Foreign Application Priority Data

Dec. 22, 2009 (EP) ..... 09015867

(51) Int. Cl.
*B65D 85/10* (2006.01)
*B65D 85/12* (2006.01)
*A24F 15/00* (2006.01)

(52) U.S. Cl.
USPC ..... 206/267; 206/270; 206/273

(58) Field of Classification Search
USPC ..... 206/267, 273, 270, 255, 913, 909, 206/242, 249, 252, 254, 261, 262, 264; 229/125.125, 112, 129, 101; 221/305, 232, 221/238, 247
See application file for complete search history.

(56) References Cited

U.S. PATENT DOCUMENTS 521,116 A * 6/1894 Ingram ..... 206/39.4
2,227,479 A * 1/1941 Zalkind ..... 229/117.12
3,125,213 A * 3/1964 Keating ..... 206/268
3,302,844 A * 2/1967 Henry ..... 229/120.18
4,126,224 A * 11/1978 Laauwe et al. ..... 206/540
4,714,082 A 12/1987 Banerjee et al.
5,205,402 A * 4/1993 Maeda ..... 206/250
5,692,525 A 12/1997 Counts et al.
2007/0284277 A1* 12/2007 Gnepper ..... 206/528
2008/0185303 A1* 8/2008 He ..... 206/249

FOREIGN PATENT DOCUMENTS

DE 29904659 U1 6/1999
GB 431721 7/1935
GB 2115386 A 9/1983
WO WO 2008/065541 A2 6/2008

OTHER PUBLICATIONS

International Search Report mailed Mar. 3, 2011 for PCT/EP2010/007258.

* cited by examiner

*Primary Examiner* — Mickey Yu
*Assistant Examiner* — Chun Cheung
(74) *Attorney, Agent, or Firm* — Buchanan Ingersoll & Rooney PC

(57) ABSTRACT

A slide and shell container comprising a shell, and a slide, which is movable in the shell along a sliding path from a closed position to an open position, wherein in the closed position the interior of the container is inaccessible, and wherein in the open position the interior of the container is accessible. The shell comprises a guide slit, extending along the sliding path, wherein a guide means of the slide engages with the guide slit. Further, a single blank for forming a slide and a single blank for forming a guide means is disclosed.

11 Claims, 3 Drawing Sheets

SLIDE AND SHELL CONTAINER

CROSS REFERENCE TO RELATED APPLICATION

This application corresponds to, and claims priority under 35 U.S.C. §119 to, European Application No. 09 015 867.6, filed Dec. 22, 2009, the entire content of which is hereby incorporated by reference.

WORKING ENVIRONMENT

The present invention relates to a slide and shell container for consumer goods. The container according to the present invention finds particular application as a container for smoking articles such as cigarettes.

It is known to package consumer goods in slide and shell containers comprising an outer shell and an inner slide mounted within the outer shell, for slidable movement relative thereto, in which the consumer goods are housed. To remove consumer goods from such containers, a consumer slides the inner slide from an initial position inside the outer shell to an open position, in which the inner slide projects outwardly from the outer shell, in order to partially expose an open end or side of the inner slide from which the consumer goods may be removed. International Application WO 2008/065541 A2 discloses a slide and shell container comprising an inner slide that can be slit to the side in an outer shell, wherein the slide is guided by the inner walls of the outer shell.

It is one aspect of this invention to provide a novel slide and shell container which enables an easier opening process.

SUMMARY OF SELECTED FEATURES OF THE PREFERRED EMBODIMENT

According to the present invention there is provided a slide and shell container which enables an easier opening process through the use of a guide slit in the shell extending along a sliding path, wherein a guide means of the slide engages with the guide slit. Thus, the movement of the slide with respect to the shell is more accurate and the opening and closing of the container is facilitated. Furthermore, the stability of the container is increased, as the engagement of the guide means with the guide slit may prevent the movement of the slide in undesired directions with respect to the shell. The guide means can be either integral with the shell or included as a separate part. The use of a separate part allows the benefit of a different material which is optimised for the sliding engagement to be used for the guide means and slide. The sliding path does not necessarily extend linearly, but may also be provided on a curved path.

Preferably, the guide means includes a cover panel covering the guide slit in the closed position of the container, and at least partially covering the guide slit in the open position of the container. The cover panel allows an integral design of the container as no opening in the shell is necessary to grasp the slide. The slide can be moved by applying force on the cover panel in the direction of the sliding path. Since the cover panel may provide a large surface for grasping the slide, the opening and closing of the container is facilitated. In particular, it may be carried out with only one hand. As a design can be provided on the cover panel, and the cover panel can be provided in various shapes, the aesthetic appearance of the container can be adapted for a desired purpose. In particular, additional consumer-related information may be included on the cover panel. Further, the covered guide slit improves the outer appearance of the container.

In one embodiment, the guide means includes a guide panel and a guide portion. The guide panel extends substantially parallel and adjacent to the inner side of the cover panel in between the cover panel and the shell. The guide portion extends through the guide slit. This enables the guide means to be manufactured from only one blank of flat material. Thus, in addition to the benefits of providing an integral part, only one side of the blank would have to be covered with a material which is suitable for grasping and sliding engagement.

In one embodiment, the guide means is a part of the blank of the slide. The guide portion is provided in between a panel of the slide and the guide panel. Thus, a slide and shell container according to the invention can be manufactured with only two blanks, one for the shell and one for the slide. Thus, the manufacturing process can be improved through a more efficient container construction process.

In another embodiment, the guide means further includes an inner panel, which is attached to the slide. The inner panel can be attached by any suitable means, but in particular by gluing. Thus, the guide means can be attached to a slide, wherein the slide and guide means may be manufactured from different materials. In particular, a material can be chosen for the guide means which is more resistant to abrasion, such as plastic or metal material.

Preferably, the guide means includes two guide panels, respectively on the upper and lower side of the cover panel. The guide panels extend towards the guide slit. At each of the guide panels a guide portion is provided extending through the guide slit. Thus, the cover panel is connected to the slide using two guide panels, and therefore the connection in between the cover panel and slide is improved. Furthermore, each of the guide portions may be engaged with one edge of the guide slit to improve the guiding accuracy.

In one embodiment, the two guide portions are individually received in two guide slits at least in some positions of the slide in between the open position and the closed position of the slide in the container. The two guide slits may be provided locally for a certain length along the sliding path, while the guide portions are guided only by the edges of one guide slit along the remaining sliding path. Depending on the position of the slide in the shell, the two guide portions are received in two separate guide slits or only in one guide slit. Thus, the sliding accuracy can be locally improved, for example near to the closed position of the slide to enable a secure closed state.

In one embodiment, the guide slits are provided in a front wall and a back wall of the shell. The cover panel of this embodiment extends at least partially around the front wall of the container, one side wall of the container and a back wall of the container. By providing guide slits at the front and back wall of the container, the guiding accuracy can be further improved. The cover panel, which extends around the three sides of the container, improves the outer appearance and the robustness of the container. Particularly, the guide means which could be visible from the side of the container are covered and protected by the cover panel.

Preferably, a protrusion is provided on the guide portion perpendicular to the edge of the guide slit and a protrusion is provided at the edge of the guide slit perpendicular to the guide portion. This is to secure the container in the closed position. Thus, just before the slide arrives in the fully closed position, the two protrusions pass each other and provide a click effect. To open the container, a force sufficient to flex the region of the protrusions has to be applied, such that the protrusions and the adjacent material are elastically deformed. Thus, the container is secured in the closed position. The protrusion can be provided in the form of a flap depending on the guide portion, respectively guide slit.

In addition or as an alternative, the flaps may also be provided to secure the container in an open position.

Preferably, the slide includes an opening on its top portion which particularly extends at least in one of the front wall or back wall of the slide. This enables and facilitates access to the interior of the container for the consumer.

Preferably, the slide includes smoking articles, in particular elongated smoking articles, such as cigarettes. The container enables to securely store the cigarettes while the slide is in the closed position. Access to the smoking articles is facilitated as the container may be easily opened and the smoking articles can be removed by the consumer.

Preferably, a retention flap is provided on at least either the slide or the shell. The retention flap interlocks with an engagement means on the slide or shell in the open position of the slide. The engagement means may be formed by a retention flap which is part of the respective blank of slide or shell and is glued to the outer side of the slide or inner side of the shell of the container, respectively. The retention flaps enable that the slide cannot be fully withdrawn from the shell, and therefore the container is prevented from being involuntarily disassembled.

An apect of the invention is also obtained by providing a single blank for forming the slide of a slide and shell container comprising: a front wall section; a side wall section; and a back wall section. Each section further includes an upper panel and a lower panel. At least one of the back wall section or front wall section includes an upper guide panel adjacent to the upper panel, a cover panel adjacent to the upper guide panel, and a lower guide panel adjacent to the cover panel and adjacent to the lower panel, wherein folding lines are provided in between the adjacent panels. Preferably, the folding lines are parallel. Thus, if the single blank is folded along the folding lines, and the back wall section, side wall section, and front wall section are folded, a slide with a guide means is provided.

The individual panels which are adjacent to each other are usually panels of an integral blank, which are delimited from each other by the folding lines. The folding lines may be creasing lines or scoring lines.

Preferably, the back wall section and front wall section include the cover panel and guide panel. In addition, the side wall section includes an adjacent side cover panel with a connecting folding line for both of the cover panels of the back wall section and the front wall section. Thus, guide means are provided at the front and the back wall of the slide created from the blank. Furthermore, the side cover panel covers a region of the side of the slide and therefore creates a continuous wall with a high quality aesthetic appearance and robustness due to the continuous cover panel on three sides of the slide.

Preferably, a cut-out is provided in between the guide panels of the back wall section and the front wall section. Thereby, the foldability of the blank at the folding lines in between the front section, side wall section and back wall section is improved. The improvement is because the cut-out preferably extends along these folding lines when the single blank is folded along the folding lines in between the upper panel and lower panel.

An aspect of the invention is also attained by a single blank for forming a guide means of a slide and shell container comprising an upper panel, an upper guide panel adjacent to the upper panel, a cover panel adjacent to the upper guide panel, a lower guide panel adjacent to the cover panel, and a lower panel adjacent to the lower guide panel, wherein folding lines are provided in between the adjacent panels. Preferably, these folding lines are parallel. This single blank enables the forming of a guide means which can be connected to a slide of a slide and shell container. This provides various benefits already described above, as well as the benefits of a separately formed slide.

BRIEF DESCRIPTION OF THE DRAWINGS

The accompanying drawings are incorporated into and form a part of the specification for the purpose of explaining the principles of the invention. The drawings are not to be construed as limiting the invention to only the illustrated and described examples of how the invention can be made and used. Further features and advantages will become apparent from the following and the more particular description of the invention, as illustrated in the accompanying drawings, wherein like reference numerals are applied to like elements and wherein.

DESCRIPTION OF THE PREFERRED EMBODIMENTS

Figure 1:
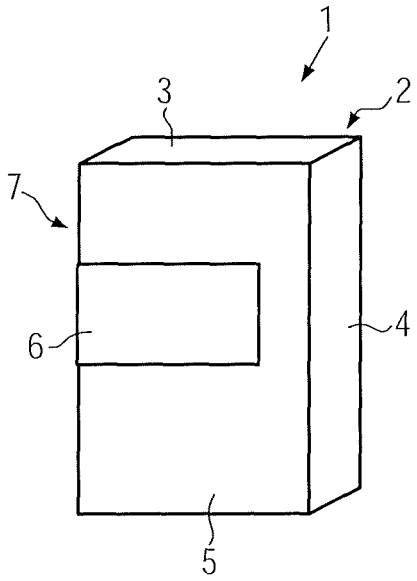
FIG. 1 is a perspective view of a first embodiment of the container according to the invention in a closed state.

The terms "front", "back", "upper", "lower", "side", "top", "bottom" and other terms used to describe relative positions of the components of containers according to the invention refer to the container in an upright position, wherein preferably the sliding path is directed to the side. The terms "left" and "right" are used with reference to side walls of the container when the container is viewed from the front in its upright position. The term "longitudinal" refers to a direction from bottom to top or vice versa. The term "transverse" refers to a direction perpendicular to the longitudinal direction across the front wall, the back wall or one of the side walls.

The walls of the slide may be printed with indicia which may be the same as, or different to the indicia printed on the shell.

Preferably, the front wall of the slide is provided with a cut out portion at the upper edge thereof. This enables more convenient access to the consumer goods within the container, without significantly reducing the surface area of the front wall of the shell.

In addition to the slide, the consumer goods within the container may be wrapped with an inner liner, which is visible above the upper edge of the front wall of the slide when the container is open.

Containers according to the invention may be substantially in the shape of a rectangular parallelepiped, with substantially right-angled longitudinal and substantially right-angled transverse edges. Alternatively, the container may include one or more rounded longitudinal edges, rounded transverse edges, bevelled longitudinal edges or bevelled transverse edges, or combinations thereof. For example, the container according to the invention may include, without limitation:

- One or two longitudinal rounded or bevelled edges on the front wall, and/or
- One or two longitudinal rounded or bevelled edges on the back wall.
- One or two transverse rounded or bevelled edges on the front wall, and/or
- One or two transverse rounded or bevelled edges on the back wall.
- One longitudinal rounded edge and one longitudinal bevelled edge on the front wall, and/or
- One transverse rounded edge and one transverse bevelled edge on the back wall.
- One or two transverse rounded or bevelled edges on the front wall and one or two longitudinal rounded or bevelled edges on the front wall.
- Two longitudinal rounded or bevelled edges on a first side wall or two transverse rounded or bevelled edges on the second side wall.

Where the container includes one or more rounded edges and is made from a laminar blank, preferably the blank includes three, four, five, six or seven scoring lines or creasing lines to form the rounded edge in the assembled container. The scoring lines or creasing lines may be either on the inside of the container or on the outside of the container. Preferably, the scoring lines or creasing lines are spaced apart from each other by between about 0.3 mm and 4 mm.

Preferably, the spacing of the creasing lines or scoring lines is in function of the thickness of the laminar blank. Preferably, the spacing between the creasing lines or scoring lines is between about 0.5 and about 4 times larger than the thickness of the laminar blank.

Where the container includes one or more bevelled edges, preferably the bevelled one or more edges have a width of between about 1 mm and about 10 mm, preferably between about 2 and about 6 mm. Alternatively, the container may include a double bevel formed by three substantially parallel creasing lines or scoring lines that are spaced apart such that two distinct bevels form on the edge of the container.

Alternatively to a container with a substantially rectangular transverse cross section, the container may have a for example a substantially polygonal cross section such as substantially triangular, substantially quadrangular or substantially hexagonal, or a cross section which is oval, semi-oval, circular or semi-circular.

Where the container includes a bevelled edge and is made from a laminar blank, the bevel may be formed by two substantially parallel creasing lines or scoring lines in the laminar blank. The creasing lines or scoring lines may be arranged symmetrically to the edge between a first wall and a second wall. Alternatively, the creasing lines or scoring lines may be arranged asymmetrically to the edge between the first wall and the second wall, such that the bevel extends further into the first wall of the container than into the second wall of the container.

The container may be formed from any suitable materials including, but not limited to, cardboard, paperboard, plastic, metal, or combinations thereof. Preferably, the cardboard has a weight of between about 100 grams per square meter and about 350 grams per square meter.

Containers according to the invention may be used as packages for a variety of consumer goods. In particularly preferred embodiments, containers according to the invention are used to package smoking articles. Containers according to the invention may be advantageously used to package smoking articles including, but not limited to, known lit-end cigarettes, cigars or cigarillos, heated smoking articles comprising a combustible fuel element or heat source and an aerosol-generating substrate (for example cigarettes of the type disclosed in U.S. Pat. No. 4,714,082) and smoking articles for use with electrical smoking systems (for example cigarettes of the type disclosed in U.S. Pat. No. 5,692,525).

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and thirty smoking articles.

Containers according to the invention may hold one, two, three four or five separate bundles of consumer goods. The separate bundles may be arranged substantially parallel to the front wall and to the back wall or substantially perpendicular to the front wall and to the back wall.

Within a bundle, the smoking articles may be arranged in different collations, depending on the total number of smoking articles, the dimensions of the smoking articles or the cross sectional shape of the container. For example, the smoking articles may be arranged in a bundle in a single row of five, six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five, six, seven, eight, nine, or ten; or four rows of four, five, six or seven. Alternatively, the two or more rows may include at least two rows containing different numbers of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Containers according to the present invention may hold smoking articles of the same type or brand, or of different types or brands. In addition, both filterless smoking articles and smoking articles with various filter tips may be contained, as well as smoking articles of differing length (for example, between about 40 mm and about 180 mm), diameter (for example, between about 4 mm and about 9 mm). In addition, the smoking articles may differ in strength of taste, resistance to draw and total particulate matter delivery. Wherein the container includes more than one bundle, each bundle within the same container may hold the same or different types of smoking articles as listed above.

Preferably, the dimensions of the container are adapted to the length of the smoking articles, and the collation of the smoking articles. Typically, the outer dimensions of the container are between about 0.5 mm to about 5 mm larger than the dimensions of the bundle of smoking articles housed inside the container.

Preferably, containers according to the invention have a height of between about 60 mm and about 150 mm, more preferably a height of between about 70 mm and about 125 mm, wherein the height is measured from the top wall to the bottom wall of the container.

Preferably, containers according to the invention have a width of between about 12 mm and about 150 mm, more preferably a width of between about 70 mm and about 125 mm, wherein the width is measured from the first side wall to the second side wall of the container.

Preferably, containers according to the invention have a depth of between about 6 mm and about 100 mm, more preferably a depth of between about 12 mm and about 25 mm wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1.

Preferably, the ratio of the width of the container to the depth of the container is in between about 1 to 1 and about 10 to 1, more preferably between about 2 to 1 and about 8 to 1, most preferably between about 2 to 1 and 3 to 1.

The exterior surfaces of containers according to the invention may be printed, embossed, debossed or otherwise embellished with manufacturer or brand logos, trade marks, slogans and other consumer information and indicia. Alternatively, or in addition, the exterior surfaces of containers according to the invention may be at least partially covered with lacquer, metallization, holograms, luminescent material, or any other materials that alter the feel, odor or appearance of the container.

Where the slide of a container according to the present invention contains one or more bundles of smoking articles, the smoking articles are preferably wrapped in an inner liner of, for example, metal foil or metallized paper.

Where the container includes smoking articles, the container may further include waste-compartments (for example for ash or butts) or other consumer goods, for example matches, lighters, extinguishing means, breath-fresheners or electronics. The other consumer goods may be attached to the outside of the container, contained within the container along with the smoking articles, in a separate compartment of the container or combinations thereof.

Once filled, containers according to the invention may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include a tear tape. The tear tape is preferably positioned around the container next to the open side wall of the shell, such that once the tear tape has been removed, the slide is free to be slid along the sliding path. In addition, there may be a second tear tape positioned around the container. Alternatively, the tear tape may be provided sideways around the container.

In FIG. 1, a container 1 according to the invention is depicted in a closed state. The shell 2 of the container 1 includes a top wall 3, a right side wall 4, a front wall 5, a bottom wall and back wall. The shell 2 is open on its left side. A cover panel 6 of a slide 7 is arranged parallel and adjacent to the outer front side wall 5 of the shell 2. It should be noted that in this embodiment a corresponding cover panel is also provided at the back side of the container 1. The cover panel 6 is an integral part of the slide 7. Alternatively, the cover panel 6 may be connected to the slide 7.

Figure 2:
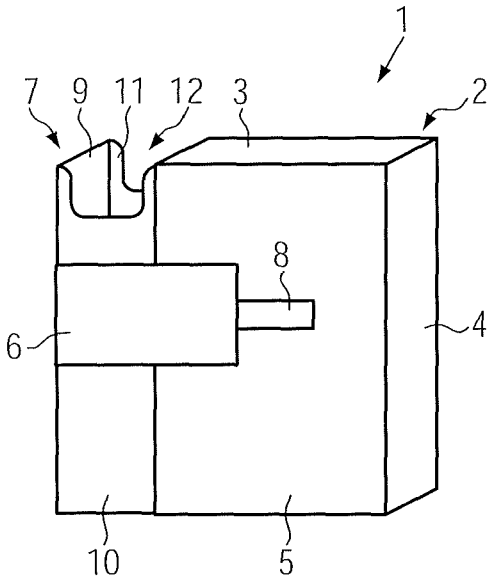
FIG. 2 is a perspective view of a first embodiment of the container according to the invention in an open state.

In FIG. 2, the container 1 is shown in an open state, wherein the slide 7 is slid along a sliding path defined by a guide slit 8 provided in the front wall 5 of the shell 2. The slide 7 includes a left side wall 9, a front wall 10, a back wall 11, and a bottom wall. Furthermore, the slide 7 may include a right side wall in some embodiments. On the top side of the slide 7, an opening 12 is defined, wherein the remaining portion on top of the slide 7 may include a top wall. The opening 12 further extends in the front side wall 10 and back side wall 11 to facilitate access to consumer articles included in the slide 7.

The consumer can easily open and close the container 1 by grasping the slide 7 at the cover panel 6 and grasping the shell at any of the outer walls, in particular at the front and back wall or the top and bottom wall of the shell 2.

Figure 3:
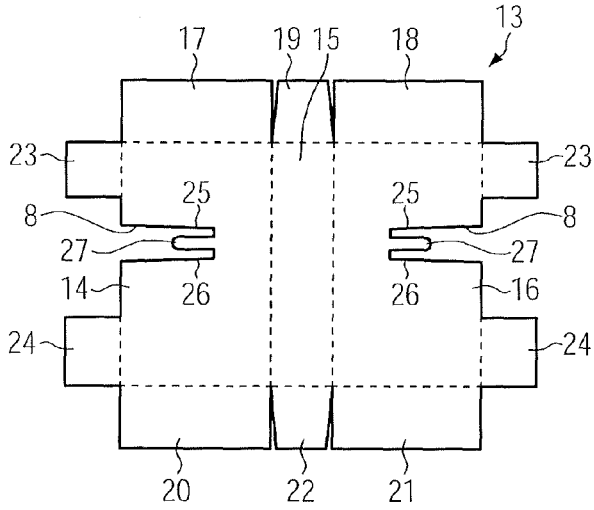
FIG. 3 is a plan view of a single blank for a shell of the container according to the invention.

In FIG. 3, a single blank 13 for forming the shell 2 is depicted, which includes a front wall panel 14, corresponding to the front wall 5 of the shell 2, a right side wall panel 15, corresponding to the right side wall 4 of the shell 2, and a back wall panel 16, corresponding to the back wall of the shell 2. Top wall panels 17, 18 and a dust flap 19 are provided for forming the top wall 3 of the shell 2, wherein the dust flap 19 ensures that the top right edge of the shell 2 is properly closed.

Bottom wall panels 20, 21 and the lower dust flap 22 are provided for forming the bottom wall of the shell 2, wherein the dust flap 22 ensures a proper closure of the bottom right edge of the shell 2. In the front wall panel 14 and back wall panel 16, the guide slits 8 are provided in a transverse direction. The guide slits 8 may be designed to increase their height towards the side of the shell blank 13 to enable an easier insertion of the slide 7 into the shell 2 during manufacture. In a further preferred embodiment, the height of the guide slits may be constant, and only increase locally at the edge of the blank 13.

Upper retention flaps 23 and lower retention flaps 24 are provided at the side edges of the front wall panel 14 and back wall panel 16. However, in another embodiment the retention flaps may be provided at the side edge of the top wall panels 17, 18 and bottom wall panels 20, 21 or bottom wall panels 20, 21.

The retention flaps 23, 24 are folded towards the inside of the walls of the shell 2. In particular, the retention flaps 23, 24 may be glued towards the inside of the walls of the shell 2.

The dashed lines in the blank 13 depicted in FIG. 3 indicate the folding lines.

Preferably, the guide slit 8 may at some point along the sliding path be divided into two separate guide slits 25, 26, separated by a tongue 27, which originates from the inner end of the guide slit 8. This feature improves the guiding accuracy of the guide slit 8, as the later described guide portions of the guide means of the slide 7 may be individually received therein.

Figure 4:
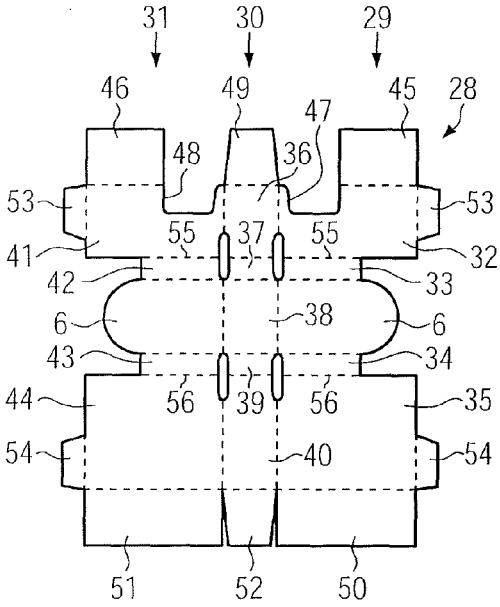
FIG. 4 is a plan view of an embodiment of the single blank for a slide according to the invention.

In FIG. 4, a single blank 28 for the slide 7 is depicted. The single blank 28 includes a front wall section 29 with an upper panel 32, an upper guide panel 33, the cover panel 6, a lower guide panel 34, and a lower panel 35. The aforementioned panels are adjacent to each other in this order and folding lines, which are indicated in FIG. 4 as dashed lines, are provided in between the panels.

A left side wall section 30 of the blank 28 for the slide 7 includes an upper panel 36, an upper inner panel 37, a side cover panel 38, a lower inner panel 39, and a lower panel 40, which are adjacent to each other in this order and adjacent to the corresponding panels of the front wall section 29, wherein folding lines are provided in between the adjacent panels.

Furthermore, the blank 28 for the slide 7 includes a back wall section 31 with an upper panel 41, an upper guide panel 42, the cover panel 6, a lower guide panel 43, and a lower panel 44 which are adjacent to each other in this order, and adjacent to the corresponding panels of the left side wall section 30, wherein folding lines are provided in between the adjacent panels.

In between the upper and lower guide panels 42, 43 and the upper and lower inner panels 37, 39 a cut-out is provided, respectively. Further, a cut-out is provided in between the upper and lower guide panels 33, 34 and the upper and lower inner panels 37, 39, respectively.

Furthermore, the blank 28 for the slide 7 includes top wall panels 45, 46 which are adjacent to the front wall upper panel 32, and back wall upper panel 41, respectively. Folding lines are provided in between the adjacent panels. The top wall panels 45, 46 form a top wall of the slide 7.

To create the opening 12 of the slide 7, the top wall panels 45, 46 do not extend over the full width of the front wall section 29, and the back wall section 31, respectively. Cut-outs 47, 48 are provided in the front wall upper panel 32 and back wall upper panel 41. Thus, the opening 12 extends into the front and back side wall 10, 11 of the slide 7, such that the access of the consumer articles included in the slide 7 is facilitated.

The blank 28 includes an upper left side wall flap 49, which can be folded to the inside of the slide 7 and glued to the back of the upper left side wall panel 36, to create a more stable upper part and edge of the left side wall 9 of the slide 7.

Furthermore, the blank 28 includes a front wall bottom flap 50, and a back wall bottom flap 51, which form the bottom wall of the slide 7, together with the dust flap 52, which enables that the lower left side edge of the slide 7 is properly closed.

Upper and lower retention flaps 53, 54 are provided at the side of the upper and lower front and back wall panels 32, 35, 41, 44 and are folded towards the outside of the slide 7, so as to interlock with the retention flaps 23, 24 of the shell 2. Thus, the retention flaps 53, 54 of the slide 7 and the retention flaps 23, 24 of the shell 2 enable a dead stop at the opening end of the sliding path. Therefore, it can be prevented that the slide 7 is fully removed from the shell 2.

The folding line in between the upper panels 32, 41 and the upper guide panels 33, 42 of the blank 28 defines an upper guide portion 55, which is adapted to engage with the upper edge of the guide slit 8 of the shell 2.

The folding line in between the lower guide panel 34, 43 and the lower panel 35, 44 of the front wall section 29, respectively back wall section 31 defines a lower guide portion 56, which is adapted to engage with the lower edge of the guide slit 8 of the shell 2.

Figure 5:
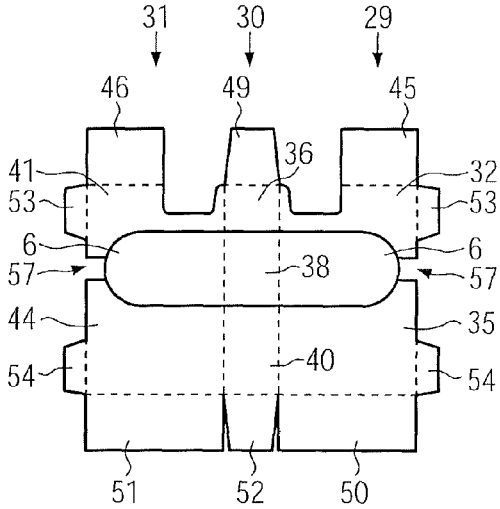
FIG. 5 is a plan view of the embodiment of the single blank for a slide in a pre-folded state according to the invention.

In FIG. 5 the blank 28 has been folded along the folding lines in between the upper panels 32, 36, 41 and the lower panels 35, 40, 44 such that a guide means 57 is created on both of the front wall section 29 and the back wall section 31 of the pre-folded blank 28.

The upper and lower guide panels 33, 34, 42, 43 are glued or adhesively attached to the inner side of the cover panel 6 in a preferred embodiment.

Thereafter, the blank 28 is folded along the remaining folding lines, such that the cover panels 6 and the side cover panel 38 are provided on the outside of the slide 7. Then, the top panels 45, 46 are glued to each other and the bottom panels 50, 51 and the dust flap 52 are glued to each other. The left side wall flap 49 is glued to the upper panel 36.

The slide 7 can then be inserted into the shell 2 to complete the manufacture of the container 1. It should be noted, that consumer articles, in particular smoking articles can be provided in the slide 7 before same is inserted into the shell 2.

In particular, the smoking articles are wrapped into an inner liner, which can at least be partially removed to enable access to the smoking articles after opening the container 1 for the first time.

Figure 6:
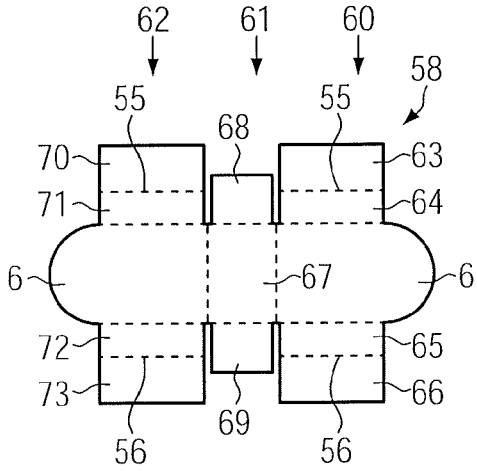
FIG. 6 is a plan view of an embodiment of the single blank for the guide means according to the invention.

In FIG. 6, a single blank 58 for forming a guide means 59 according to the invention is disclosed. The blank 58 includes a front section 60, a left section 61, and a back section 62.

The front section 60 includes an upper panel 63, an upper guide panel 64, the cover panel 6, a lower guide panel 65 and a lower panel 66, which are adjacent to each other in this sequence. Folding lines are provided in between the adjacent panels.

In the left section 61, the panel 58 includes a left side cover panel 67, from which an upper and lower flap 68, 69 are depending on folding lines. The upper and lower flaps 68, 69 can be folded on the inner side of the left side cover panel 67 to provide a more stable upper and lower edge of same.

The back section 62 includes an upper panel 70, an upper guide panel 71, the cover panel 6, a lower guide panel 72, and a lower panel 73, which are adjacent to each other in this sequence and is provided with folding lines in between the panels. Again, the upper guide portion 55 is defined in between the upper panels 63, 70 and the upper guide panels 64, 71. The lower guide portion 56 is defined in between the lower guide panels 65, 72 and lower panels 66, 73.

Figure 7:
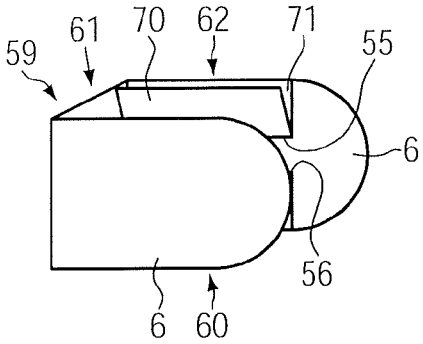
FIG. 7 is a perspective view of the guide means.

The panel 58 for the guide means 59 is folded in a configuration as depicted in FIG. 7, wherein in a preferred embodiment the guide panels 64, 65, 71, 72 are glued to the inner side of the cover panels 6.

Figure 8:
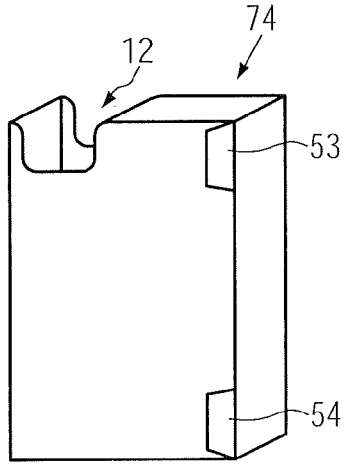
FIG. 8 is a perspective view of a slide which can be combined with the guide means.

In FIG. 8, a slide 74 is depicted, to which the guide means 59 can be attached, in particular by gluing. Thus, a slide comparable to the one manufactured by the single blank of FIG. 4, can be obtained. As can be seen in FIG. 8, the slide 74 includes similar retention flaps 53, 54 to the slide 7 manufactured from the single blank 28.

Figure 9:
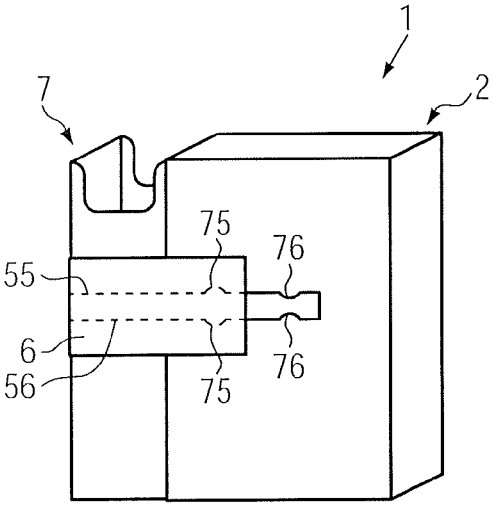
FIG. 9 is a perspective view of a further embodiment of the container according to the invention in an open position.

In FIG. 9, a further embodiment of a shell and slide container 1 according to the invention is depicted, wherein in this embodiment first protrusions 75 are provided at the guide portions 55, 56 of the guide means 57, 59. Further, second protrusions 76 are provided at the upper and lower edges of the guide slit 8 protruding into the guide slit 8, such that during the sliding of the slide 7 from a closed position to an open position, the first and second protrusions 75, 76 have to cross each other. Therefore, the slide 7 is secured in the closed position. The guide portions 55, 56 including the first protrusions 75 are depicted in dashed lines to emphasize that they are not visible from the outside of the container 1. The protrusions may be formed by additional flaps protruding from the guide portions 55, 56 or guide slit 8 into the sliding path, respectively.

Figure 10:
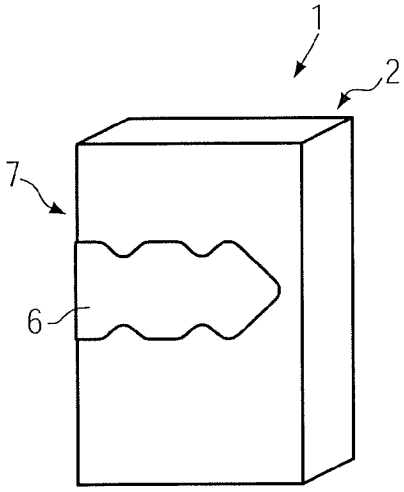
FIG. 10 is a perspective view of a further embodiment of the container according to the invention in a closed position.

In FIG. 10, a further embodiment of a container 1 according to the present application is depicted, wherein the cover panel 6 includes a specific shape which may be used for various marketing purposes, and to increase the value of aesthetic appearance of the container. Further, the specific shape may facilitate the grasping of the cover panel 6.

Generally, it should be emphasized, that the slide can either be manufactured from one single blank, as depicted in FIG. 4, or by combination of an element as depicted in FIG. 8, with a guide means as depicted in FIG. 7. Thus, in case of the latter, different materials can be used for the guide means and for the remaining part of the slide element. In particular, the guide panel may be attached, e.g. by gluing, to the cover panel.

It should be emphasized that the folding lines may be provided within a single blank or may be provided at the connections of separate panels. Further, the folding lines may provide a line of reduced thickness in the blank material to facilitate the folding or may just refer to lines along which folding is intended, but which are not modified with respect to the remaining blank.

In this specification the word "about" is often used in connection with numerical values to indicate that mathematical precision of such values is not intended. Accordingly, it is intended that where "about" is used with a numerical value, a tolerance of ±10% is contemplated for that numerical value.

In this specification, the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred slide and shell container with reference to specific embodiment(s) thereof, it will be apparent to those skilled in the art that various changes and modifications may be made to features of the slide and shell container that do not materially depart from the spirit and scope of the invention. Accordingly, all such changes, modifications, and equivalents that fall within the spirit and scope of the invention as defined by the appended claims are intended to be encompassed thereby.

What is claimed is:

1. A slide and shell container, comprising:

a shell, and a slide having an interior cavity, movable in the shell along a sliding path from a closed position where the interior cavity is inaccessible, to an open position where the interior cavity is accessible, wherein the shell further includes a guide slit, extending along the sliding path, wherein a guide means of the slide engages the guide slit, wherein the guide means comprises a cover panel covering the guide slit in the closed position, and at least partially covering the guide slit in the open position, wherein the guide means comprises two guide panels, respectively positioned on an upper side and a lower side of the cover panel, and wherein the guide panels extend towards the guide slit, and at each of the guide panels, a guide portion is provided extending through the guide slit.

2. The slide and shell container according to claim 1, wherein at least one of the guide panels extends substantially parallel and adjacent to an inner side of the cover panel, in between the cover panel and the shell.

3. The slide and shell container according to claim 1, wherein the guide means further includes an inner panel, which is attached to the slide by adhesive.

4. The slide and shell container according to claim 1, wherein each guide portion is individually received in a corresponding guide slit at least in some positions of the slide in between the open position and the closed position.

5. The slide and shell container claim 1, wherein a first protrusion is provided on the guide portion generally perpendicular to an edge of the guide slit and a second protrusion is provided at the edge of the guide slit generally perpendicular to the guide portion, so as to secure the container in the closed position.

6. The slide and shell container according to claim 1, wherein the slide includes an opening on a top portion of the slide, which extends at least in one of a front wall or a back wall of the slide.

7. The slide and shell container according to claim 1, wherein a retention flap is provided on at least one of the slide and the shell, wherein the retention flap engages with an engagement means of the other of slide and shell in the open position of the slide.

8. The slide and shell container according to claim 1, wherein the slide includes smoking articles.

9. The slide and shell container according to claim 8, wherein the smoking articles are cigarettes.

10. A slide and shell container, comprising:

a shell, and a slide having an interior cavity, movable in the shell along a sliding path from a closed position where the interior cavity is inaccessible, to an open position where the interior cavity is accessible, wherein the shell further includes a guide slit, extending along the sliding path, wherein a guide means of the slide engages the guide slit, wherein the guide means comprises a cover panel covering the guide slit in the closed position, and at least partially covering the guide slit in the open position, a guide panel which extends substantially parallel and adjacent to an inner side of the cover panel, in between the cover panel and the shell, and a guide portion which extends through the guide slit, and wherein the guide means is a part of a blank of the slide and the guide portion is provided in between a panel of the slide and the guide panel.

11. A slide and shell container, comprising:

a shell, and a slide having an interior cavity, movable in the shell along a sliding path from a closed position where the interior cavity is inaccessible, to an open position where the interior cavity is accessible, wherein the shell further includes guide slits, extending along the sliding path, wherein a guide means of the slide engages the guide slits and the guide means comprise a cover panel covering the guide slit in the closed position, and at least partially covering the guide slit in the open position, wherein the guide slits are provided in a front wall and a back wall of the shell, and the cover panel extends at least partially around a front wall of the container, one side wall of the container and a back wall of the container.

* * * * *